United States Patent [19]

Fukuchi et al.

[11] Patent Number: 4,908,287

[45] Date of Patent: Mar. 13, 1990

[54] IMAGE FORMING METHOD AND APPARATUS THEREFOR

[75] Inventors: Masakazu Fukuchi; Satoshi Haneda, both of Hachioji, Japan

[73] Assignee: Konishiroku Photo Industry Co., Ltd., Tokyo, Japan

[21] Appl. No.: 68,140

[22] Filed: Jun. 29, 1987

[30] Foreign Application Priority Data

Jul. 4, 1986 [JP] Japan ..... 61-157570

[51] Int. Cl.[4] ..... G03G 13/16

[52] U.S. Cl. ..... 430/58; 430/126; 430/42; 355/326

[58] Field of Search ..... 430/54, 126, 42; 355/326

[56] References Cited

U.S. PATENT DOCUMENTS 4,428,662 1/1984 Day ..... 355/3 R
4,562,129 12/1985 Tanaka et al. ..... 430/54
4,578,331 3/1986 Ikeda et al. ..... 430/42
4,679,929 7/1987 Haneda et al. ..... 430/54
4,723,146 2/1988 Kashara ..... 430/42

FOREIGN PATENT DOCUMENTS 0090595 10/1983 European Pat. Off. .
58-57139 4/1983 Japan .

*Primary Examiner*—John L. Goodrow
*Attorney, Agent, or Firm*—Jordan B. Bierman

[57] ABSTRACT

An image forming method wherein a latent image is formed by one of plurality of latent image forming devices and developed by one of plurality of developing devices. The above steps are repeated to form an image. An image forming apparatus having a first latent image forming device, a first developing device, a second latent image forming device, and a second developing device sequentially arranged in face of an image retainer in this order.

22 Claims, 7 Drawing Sheets

IMAGE FORMING METHOD AND APPARATUS THEREFOR

BACKGROUND OF THE INVENTION

1. Field of the Invention

The present invention relates to an image forming method and an apparatus therefor and, more particularly, to the image forming method and apparatus suitable for image formations by the electrophotography.

2. Description of the Prior Art

In recent years, there appears an image forming apparatus for making full-color copies by using a full-color original image (or document) in the image forming by the electrophotography. The multi-color image is very favorable not only for reproducing pictures of figures, still lives, landscapes and so on but also for diagrams, tables and so on because one recorded image can incorporate many pieces of informations.

From the circumstances described above, there have been proposed a variety of methods of and apparatus for forming the multi-color images.

In one method (as is disclosed in Japanese Patent Laid-Open Nos. 106743/1977, 144452/1981 and 79261/1983), for example, a plurality of latent image forming means and a plurality of developing means are arranged around a rotating drum-shaped photosensitive member, visible images of different colors are formed and superposed on the drum-shaped photosensitive member by repeatedly forming and developing the latent images and are transferred altogether to a sheet of recording paper.

In another method (as is disclosed in Japanese Patent Laid-Open Nos. 76766/1985 and 95456/1985), one latent image forming means and a plurality of developing means are arranged around a rotating drum-shaped photosensitive member to form and develop a latent image of one color for each rotation of the photosensitive member, and multi-color visible images are formed on the photosensitive member as a result of rotations of the photosensitive member and are transferred altogether to a sheet of recording paper.

In case the colors to be reproduced are full colors including yellow, magenta and cyan colors, and a black color, if necessary, according to the former method, the number of the latent image forming means and the developing means to be arranged around the photosensitive member is equal to the number of the kinds of the above-specified colors so that the photosensitive member has an increased diameter to enlarge the size of the apparatus.

According to the latter method, on the contrary, the apparatus can be made smaller than that of the former method because of the single latent image forming means. However, the photosensitive member has to make the same rotations as the number of the kinds of the colors so that the rate of forming the multi-color image is dropped.

SUMMARY OF THE INVENTION

An object of the present invention is to provide the image forming method and apparatus which can solve the aforementioned problems accompanying the prior art and form an image at a high rate without increasing the size of the apparatus.

According to a feature of the present invention, there is provided an image forming method which is characterized in that, when the steps of forming and developing latent images by using a plurality of latent image forming means and a plurality of developing means for developing the respective latent images formed by said latent image forming means are repeated to form an image, at least one of said latent image forming means is repeatedly used.

According to a preferable embodiment of the present invention, there is provided an image forming apparatus which is characterized: in that first latent image forming means, first developing means, second latent image forming means and second developing means are sequentially arranged with respect to an image retainer; and in that each of said first developing means and/or said second developing means is composed of a plurality of developing devices.

Other objects and features of the present invention will be described in detail in the following with reference to the accompanying drawings.

DESCRIPTION OF THE PREFERRED EMBODIMENTS

Figure 1:
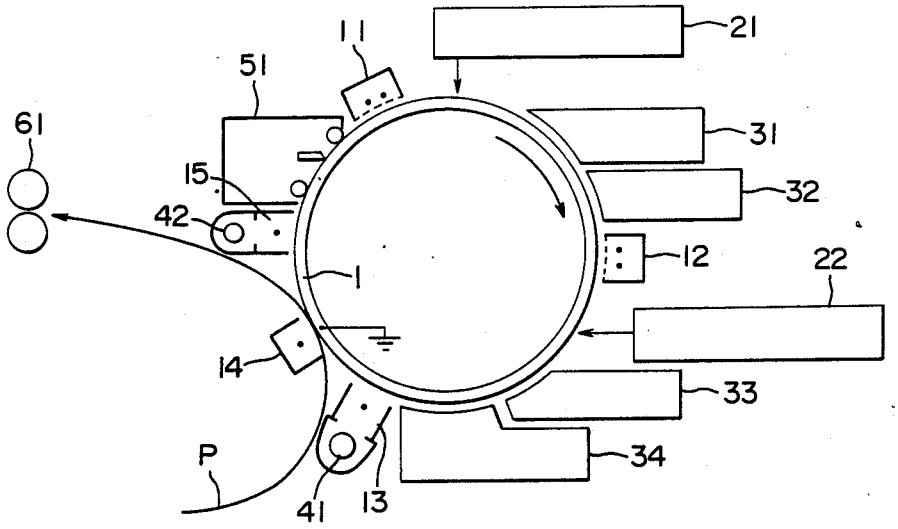
FIGS. 1(*a*) and 1(*b*) are explanatory views showing one example of a recording apparatus for implementing the method of the present invention.
Figure 1:
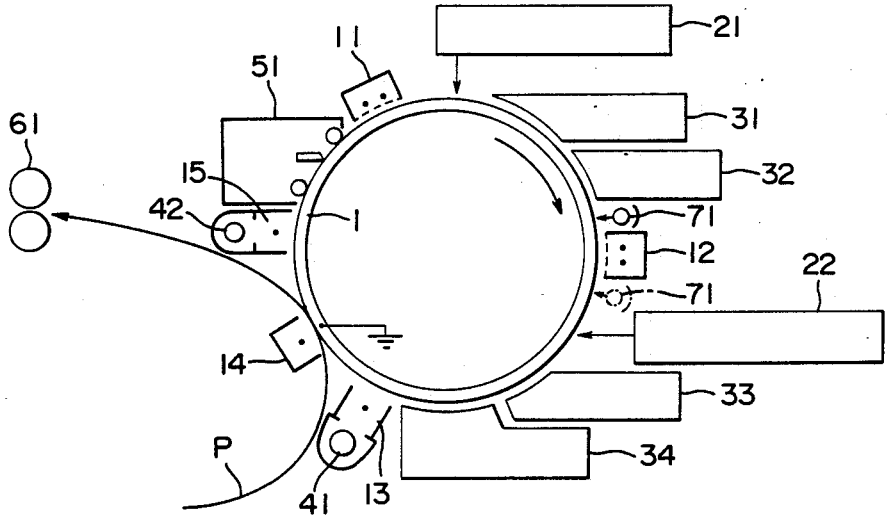

In the recording apparatus of FIG. 1(*a*), reference numeral 1 designates a drum-shaped image retainer which has a surface layer of a photoconductive and photosensitive material such as Se and which is made rotatable in the direction of arrow. Numerals 11 and 12 designate chargers for charging the surface of the image retainer 1 uniformly. Numerals 21 and 22 designate image exposing units for different colors of a color image. Numerals 31 to 34 designate developing devices which use toners of different colors such as yellow, magenta, cyan and black colors as developers. Numerals 13 to 41 designate a pre-transfer charging device and a pre-transfer exposure lamp which are disposed, if necessary, for facilitating either transfer of a color image, which is formed of a plurality of color toner images superposed on the image retainer 1, to a transfer member P or separation of the transfer member P. Numeral 14 designates a transfer device. Numeral 61 designates a fixing device for fixing the toner images transfered to the transfer member P. Numerals 42 and 15 designate a charge eliminating lamp and a charge eliminating corona discharger, respectively, one or both of which are used in combination. Numeral 51 designates a cleaning device which is equipped with a cleaning blade or fur brush for coming into contact with the surface of the image retainer 1, from which the color image has been transferred, to remove the residual toner from that surface and for leaving the surface of the image retainer 1 until it is reached by the surface having been subjected to the first development.

Here, especially in the recording apparatus in which the already charged surface of the image retainer 1 is additionally charged, there is preferably used a scorotron corona discharger, as shown, which can give a stable charge with little influence by the preceding charge. As in this recording apparatus using the drum-shaped image retainer 1, on the other hand, the image exposing units 21 and 22 may be those which are filtered from the slit exposures, as in an electrophotographic copying machine of an ordinary monochromatic type. In order to record a clear color image, the image exposures may preferably be established by the laser beam scanner shown in FIGS. 2(*a*) and 2(*b*).

Figure 8:
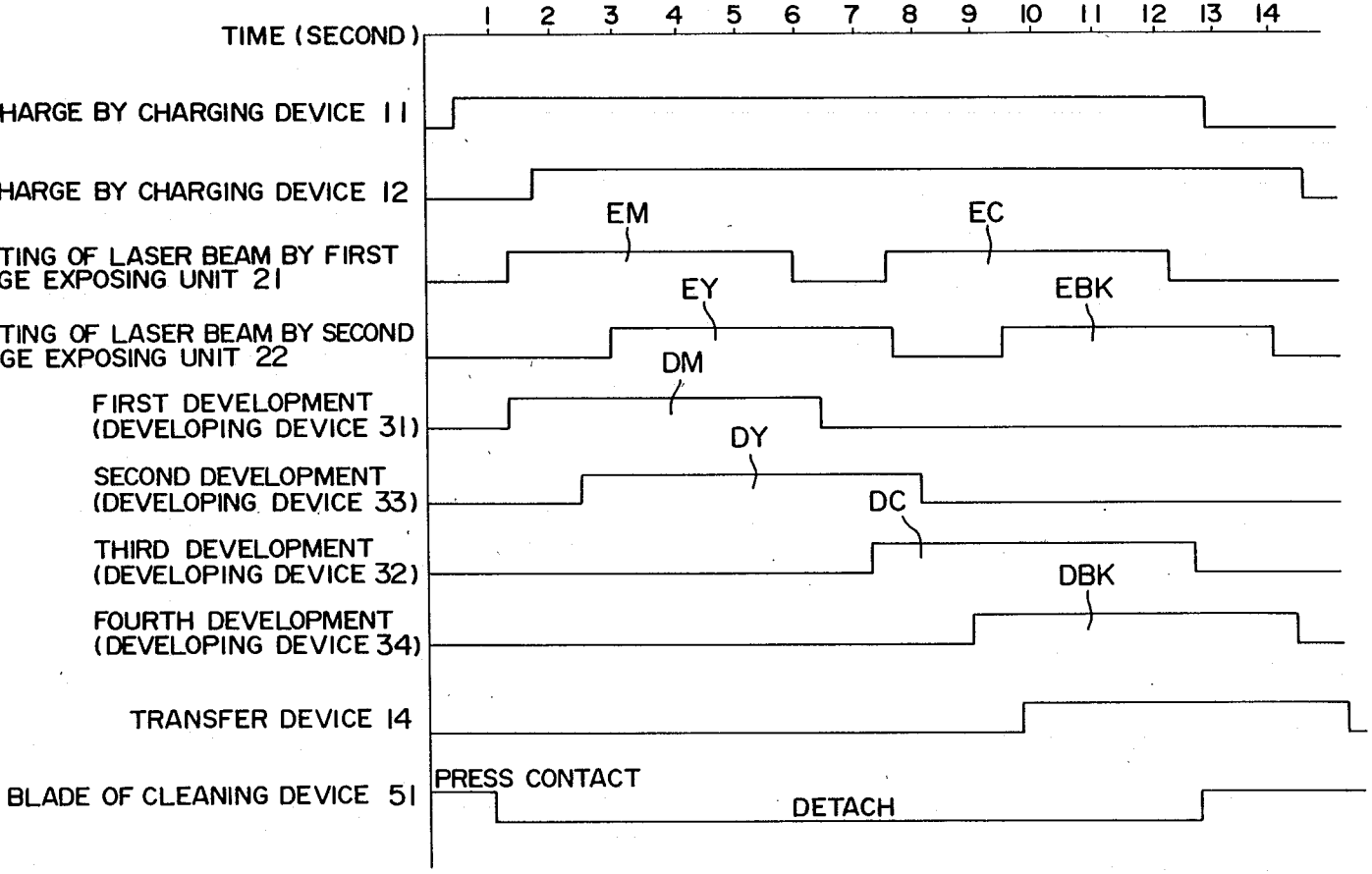
FIG. 8 is a timing chart showing the operation of the apparatus of FIG. 1(*a*)

FIG. 8 shows the operation timing of the main devices of the apparatus shown in FIG. 1(*a*).

In FIG. 8, EM, EY, EC and EBK show the durations of the latent images under writing operation state corresponding to magenta, yellow, cyan and black, respectively, and DM, DY, DC and DBK show durations in which the developing devices 31, 32, 33 and 34 having magenta, yellow, cyan and black toners, respectively, can be operated to develop.

Figure 2A:
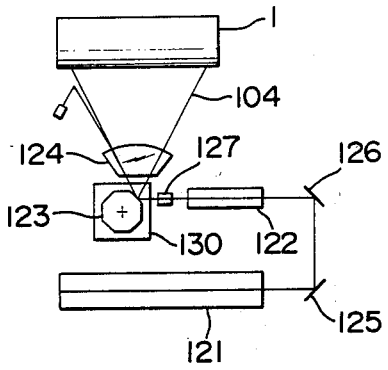
FIGS. 2(*a*) and 2(*b*) are schematic views showing the structure of a laser beam scanner for image exposure.
Figure 2B:
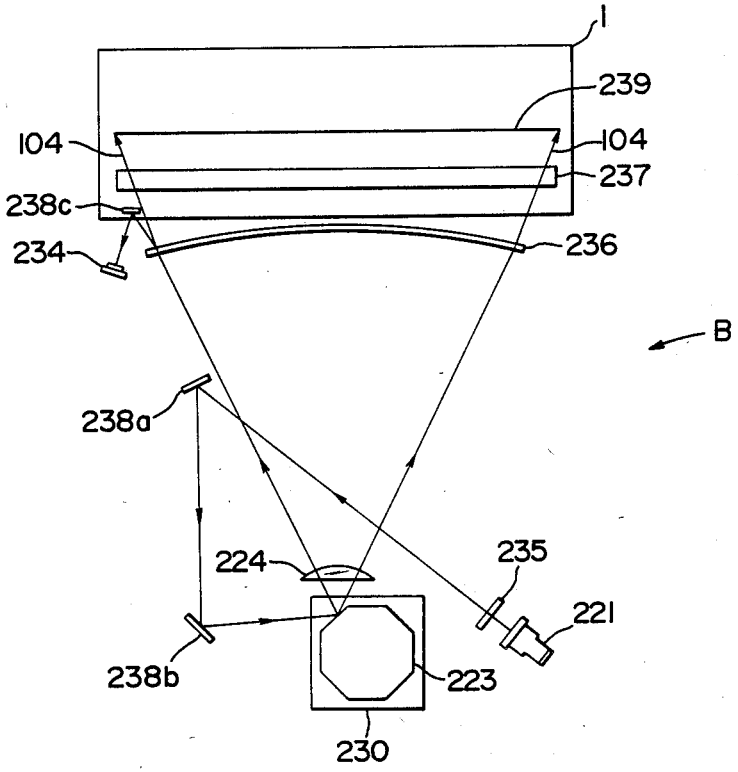

In the laser beam scanner of FIG. 2(*a*), a laser beam emitted from a laser 121 such as He-Ne laser is turned on and off by an acousto-optical modulator 122 and is deflected by a mirror scanner 123, which is composed of an octagonal mirror rotated by a drive motor 130, so that it is formed through a focusing f-$\theta$ lens 124 into an image exposure 104 for scanning the surface of the image retainer 1 at a constant rate. Incidentally, reference numerals 125 and 126 designate mirrors, and numeral 127 designates a lens for enlarging the diameter of a beam which is incident upon the focusing f-$\theta$ lens 124 so as to reduce the diameter of the beam on the image retainer 1. If the laser beam scanner shown in FIG. 2(*a*) is used for forming the image exposure 104, electrostatic images of different colors can be formed with a lag, as will be described hereinafter, so that a clear color image can be recorded. On the other hand, the laser beam scanner can suitably use the structure shown in FIG. 2(*b*). As shown, a laser beam generated by a semiconductor laser 221 is rotationally scanned by a polygon mirror 223, which is rotated by a drive motor 230, and has its optical path deflected through an f-$\theta$ lens 224 by a reflecting mirror 237 so that it is projected on the surface of the image retainer 1 to form a bright line 239. Numeral 234 designates an index sensor for detecting the start of the beam scan. Numerals 235 and 236 designate cylindrical lenses for correcting the angle of deflection. Numerals 238*a*, 238*b* and 238*c* designate reflecting mirrors for forming beam scanning and detecting optical paths.

When the scan is started, the beam is detected by the index sensor 234 so that the modulation of the beam by a first color signal is started by a not-shown modulation unit. The beam thus modulated scans the image retainer 1 which is uniformly charged in advance by the charging device 11 or 12. A latent image corresponding to the first color is formed on the surface of the drum by the main scan with the laser beam scanner and the auxiliary scan resulting from the rotations of the image retainer 1.

As the case may be, for example, in case the informations of an image to be reproduced are arrayed in one page sequentially in the rotating direction of the image retainer, only one of the laser beam scanners of the image exposing units 21 and 22 may be used. In this case, suitable optical systems such as beam splitters may be used and arranged for image exposures at two positions of the image retainer. Then, the apparatus may possibly have its size reduced and its cost dropped.

On the other hand, the laser beam 104 should not be limited to the slit exposure or the dot exposure of the laser beam, as has been described hereinbefore, but can be established by means of an LED, a CRT, a liquid crystal or an optical fiber transmitter, for example. In the recording apparatus in which the image retainer can take a flat shape as a belt, moreover, the image exposure can be a flash exposure.

Figure 3:
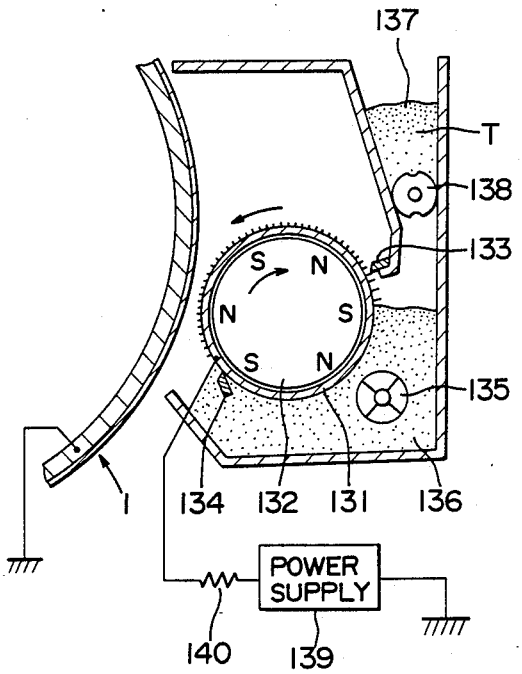
FIG. 3 is a partially sectional view showing one example of a developing device.

On the other hand, the developing devices 31 to 34 having the structure shown in FIG. 3 can preferably be used.

In FIG. 3 reference numeral 131 designates a developing sleeve which is made of a non-magnetic material such as aluminum or stainless steel. Numeral 132 designates a magnet disposed in the developing sleeve 131 and having a plurality of magnetic poles in the circumferential direction. Numeral 133 designates a layer thickness regulating blade for regulating the thickness of a developer layer which is formed on the developing sleeve 131. Numeral 134 designates a scraper blade for removing a developer layer after development from the surface of the developing sleeve 131. Numeral 135 designates an agitating rotor for agitating the developer in a developer reservoir 136. Numeral 137 designates a toner hopper. Numeral 138 designates a toner supply roller having toner receiving recesses on its surface for supplying toner from the toner hopper 137 to the developer reservoir 136. Numeral 139 designates a power supply for applying a bias voltage containing a vibratory voltage component, as the case may be, to the developing sleeve 131 through a protecting resistor 140 to generate an electric field for controlling the motions of toner between the developing sleeve 131 and the image retainer 1. As shown, the developing sleeve 131 and the magnet 132 are rotated in the direction of arrows. However, either the developing sleeve 131 or the magnet 132 may be fixed, or both the developing sleeve 131 and the magnet 132 may rotate in the common direction. In case the magnet 132 is fixed, it is the current practice to strengthen the magneticism or to arrange two identical or different magnetic poles close to each other so that the density of magnetic flux of a magnetic pole facing the image retainer 1 may be higher than that of another magnetic pole.

In the developing device thus constructed, the magnet 132 has its magnetic poles magnetized usually to have a density of magnetic flux of 500 to 1,500 gauses. By this magnetic force, the developer of the developer reservoir 136 is attracted onto the surface of the developing sleeve 131. The developer thus attracted has its thickness regulated by the layer thickness regulating blade 133 to form a developer layer. This developer layer is carried in the same direction as (as shown) or in the opposite direction to the rotating direction of the image retainer 1, as indicated by the arrow, to develop an electrostatic image of the image retainer 1 in a developing region in which the surface of the developing sleeve 131 faces that of the image retainer 1. The residual developer is scraped off from the surface of the developing sleeve 131 by the action of the scraper blade 134 until it is returned to the developer reservoir 136. Moreover, the developments are preferred to resort to the so-called "non-contact development" conditions for at least the second or later developments, which are repeated for superposing the color toner images, so that the toner having sticked to the image retainer 1 during the preceding development may be displaced by a succeeding development. The above-specified non-contact development is conducted as follows: the developer layer on the developing sleeve 131 is spaced from the image retainer 1 while it is supplied with no developing bias; and a DC and AC superposed bias is applied to the developing sleeve 131 so that the toner may fly under the alternating electric field onto the image retainer 1.

FIG. 3 shows the state in which the development is conducted under the non-contact development conditions.

Moreover, the developing devices 31 to 34 may preferably use the so-called "two-component developer", which is composed of a mixture of a non-magnetic toner and a magnetic carrier and which need not contain a black or brown magnetic material in its toner but can provide a clear color toner and can control the charge of the toner easily. Specifically, the magnetic carrier is prepared by dispersing and containing fine particles of a ferromagnetic or paramagnetic material such as ferrosoferric oxide, $\gamma$-ferric oxide, chromium dioxide, manganese oxide, ferrite or manganese-copper alloy in a resin such as styrene, vinyl, ethylene, rosin-modified, acrylic, polyamide, epoxy or polyester resin. Otherwise, the magnetic carrier is prepared by covering the surfaces of the particles of those magnetic materials with the aforementioned resins. The magnetic carrier may preferably be an insulating carrier having a resistivity of $10^8$ $\Omega$cm or higher, more preferably $10^{13}$ $\Omega$cm or higher. If this resistivity were low, there would arise problems that charges are injected into the carrier particles, if the bias voltage is applied to the developing sleeve 131, to make the carrier particles liable to stick to the surface of the image retainer 1, and that the bias voltage cannot be applied sufficiently. Especially if the carriers stick to the image retainer 1, the color tone of a color image is adversely affected.

Incidentally, the resistivity takes a value obtained by tapping particles in a container having a sectional area of 0.50 $cm^2$, by applying a load of 1 $kg/cm^2$ to the tapped particles, and by reading a current value when a voltage for establishing an electric field of 1,000 V/cm is applied between the load and the bottom electrode.

On the other hand, the carrier having an average particle diameter smaller than 5 $\mu$m will have an excessively weak magneticism whereas the carrier having an average particle diameter larger than 50 $\mu$m will not improve the image but is liable to cause the breakdown or discharge so that it will not allow application of high voltage. From these tendencies, it can be concluded that the average particle diameter of the carrier be preferably within an range of 5 $\mu$m to 40 $\mu$m. A fluidizing agent such as hydrophobic silica is suitably applied as an additive, if necessary.

The toner is preferably prepared by adding a variety of pigments and, if necessary, a charge controller to a resin to have an average particle diameter of 1 to 20 $\mu$m and an average quantity of charge of 3 to 300 $\mu$c/g, more preferably 10 to 100 $\mu$c/g. The toner becomes reluctant to leave the carrier, if its average particle diameter is smaller than 1 $\mu$m, and liable to deteriorate the resolution of an image if its average particle diameter exceeds 20 $\mu$m.

If the developer made of the mixture of the insulating carrier and the toner described above is used, the bias voltage to be applied to the developing sleeve 131 of FIG. 3 can be so set without any danger of leakage that the toner can sufficiently stick to an electrostatic image without any fogging. Incidentally, in order to effectively control the developing movement of the toner by the application of such bias voltage, the toner may contain such a magnetic material within a range retaining the color clearness as is used in the magnetic carrier.

The structure of the developing device and the composition of the developer thus far described are preferably used in the method of the present invention. However, the present invention should not be limited thereto but can use the developing devices and the developers, as are disclosed in Japanese Patent Laid-Open Nos. 30537/1975, 18656 to 18659/1980, 144452/1981, and 116553 and 116554/1983. More preferably, the non-contact development conditions with the two-component developers may be used, as are disclosed in the specifications of Japanese Patent Applications Nos. 57446/1983, 96900 to 96903/1983, 97973/1983, 192710 and 192711/1985, 14537/1985, 14539/1985, and 176069/1985, all of which are assigned to the present Applicant. Of these, the developing device disclosed in Japanese Patent Laid-Open No. 176069/1985 is preferred because the development is conducted in a portion having a thin developer layer between magnetic poles with the magnet being fixed in the developing sleeve so that the developing gap can be narrowed to establish a sufficiently strong developing electric field thereby to provide a high developing performance. The presence of the irrotational magnet is also advantageous for the image forming apparatus which is equipped with a plurality of developing devices.

Incidentally, each image exposure has to be conducted in an accurately registered position on the image retainer. The positions of these image exposures can be easily and accurately determined by the ordinary position detection and image exposure timing control using a photosensor, by which one (or several, if necessary, not shown) registration index marker (although not shown) disposed in a predetermined position of the image retainer is detected for each rotation of the image retainer, so that the image obtained has no color deviation.

In the aforementioned recording method, as has been described hereinbefore, the toner image formed on the image retainer 1 is transferred directly to the transfer member P from the image retainer 1 by the transfer device 14 without any use of a transfer drum so that the apparatus can be small-sized without any color deviation.

The methods of the present invention shown in FIGS. 4 to 7 can be implemented by the recording apparatus thus far described. Incidentally, all of FIGS. 4 to 7 show the stage before which a second development has been conducted.

Figure 4:
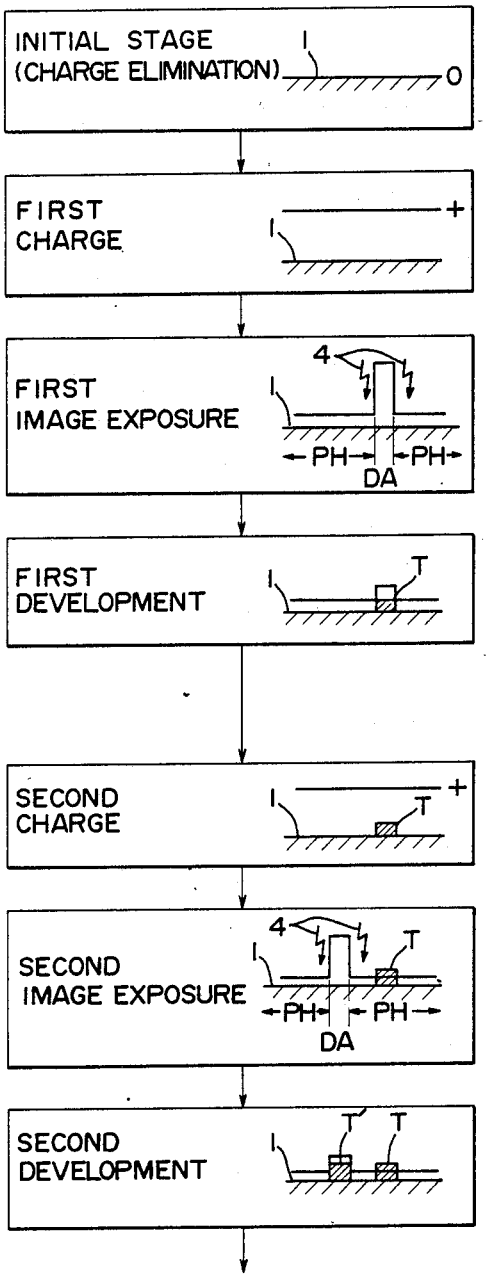
FIGS. 4 to 7 are flow charts for implementing the method of the present invention, respectively.

FIG. 4 shows an embodiment of the present invention, in which an electrostatic image is formed by the electrostatic image forming method for forming an image exposed portion in the background and the electrostatic image in the unexposed portion and in which the development is effected as a result that the toner for charging in an opposite polarity sticks to the electrostatic image. According to the recording apparatus of FIG. 1(*a*), more specifically, the surface of the image retainer 1 in its initial stage, which has its charge eliminated by the charge eliminating devices 15 and 42 and cleaned by the cleaning device 51 to have a zero potential, is uniformly subjected for its first rotation to a first charging operation by the charging device 11. The surface thus charged is subjected to a first image exposure to the image exposing unit 21, such that the potential in the portion other than the electrostatic image is substantially at zero. The potential thus obtained effects the first development with the electrostatic image substantially equal to the potential of the first charging operation either of the developing devices 31 and 32, which uses the developer of the color toner corresponding to the first image exposure, so that the toner T charged in the opposite polarity sticks.

A second charging operation is uniformly conducted by the charging device 12. A second image exposure for reducing the potential in the portion other than the electrostatic image substantially to zero is conducted again with the image exposing unit 22. The electrostatic image thus obtained is subjected to a second development with a toner T' by either of the remaining developing devices 33 and 34, which uses the developer of the corresponding color.

Next, for second rotation, third and fourth electrostatic image formations and developments are repeated with the pre-transfer charging device and exposing lamp 13 and 41, the transfer device 14, the charge eliminating devices 15 and 42 and the cleaning device 51 being inoperative. When the fourth development is conducted to form a color image having the color toner images superposed, the pre-transfer charging device 13 and the pre-transfer exposing lamp 41 are operated until the color image passes. Then, the color image is transferred by the transfer device 14 to the transfer member P which is being fed in synchronism with the rotation of the image retainer 1. The color image thus transferred is fixed on the transfer member P by the fixing device 61. The surface of the image retainer 1 bearing the transferred color image has its charges eliminated by the charge eliminating devices 15 and 42 and is cleaned by the cleaning device 51 to restore its initial state. Thus, the one color image recording cycle is completed in the embodiment of the present invention. In other words, the charging operations for the individual formations of the electrostatic images are conducted twice by the charging devices 11 and 12, and the image exposures are also conducted twice by the two exposing devices which are made by the laser beam scanner of FIG. 2, for example. As a result, the recording apparatus can be made in a small size and at a low cost and can record at a high speed.

In this embodiment of FIG. 4, the developments are conducted by the developing method using the toners for charging the electrostatic images in opposite polarities. As a result, the developed densities of the individual colors can be easily increased to record a clear color image easily. Incidentally, in order to avoid the color mixture, the DC biases in the developments may be set to be sequentially the higher at the later steps. The charged potentials may accordingly be set to become sequentially the higher.

Figure 5:
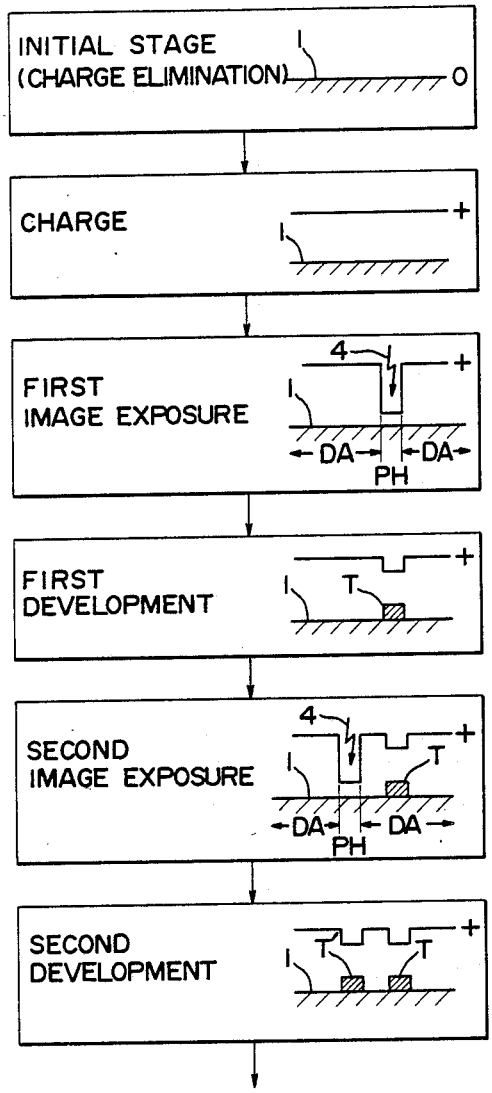
Figure 6:
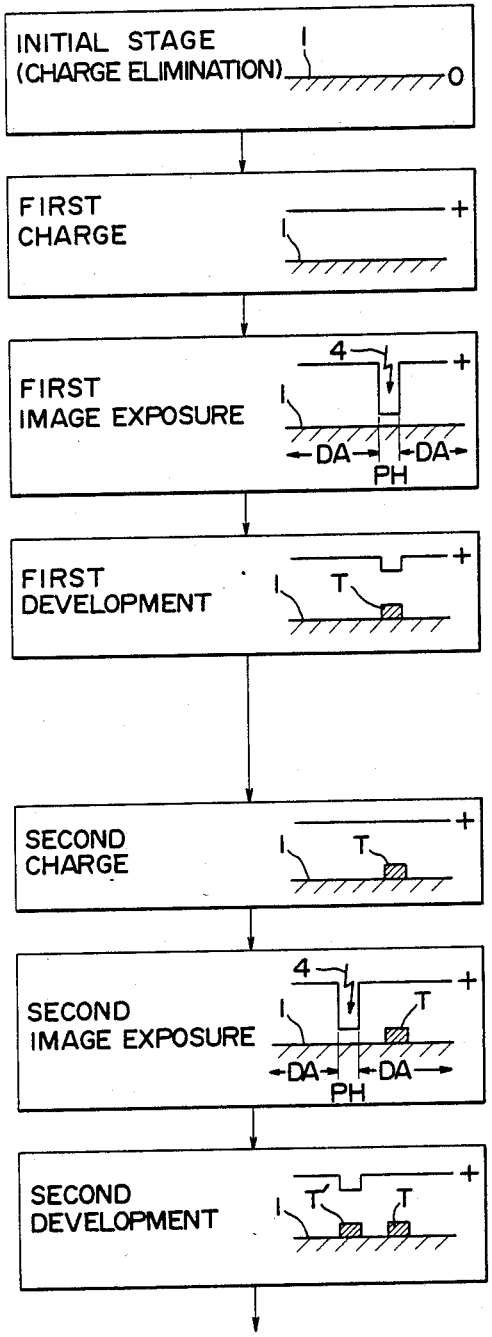
Figure 7:
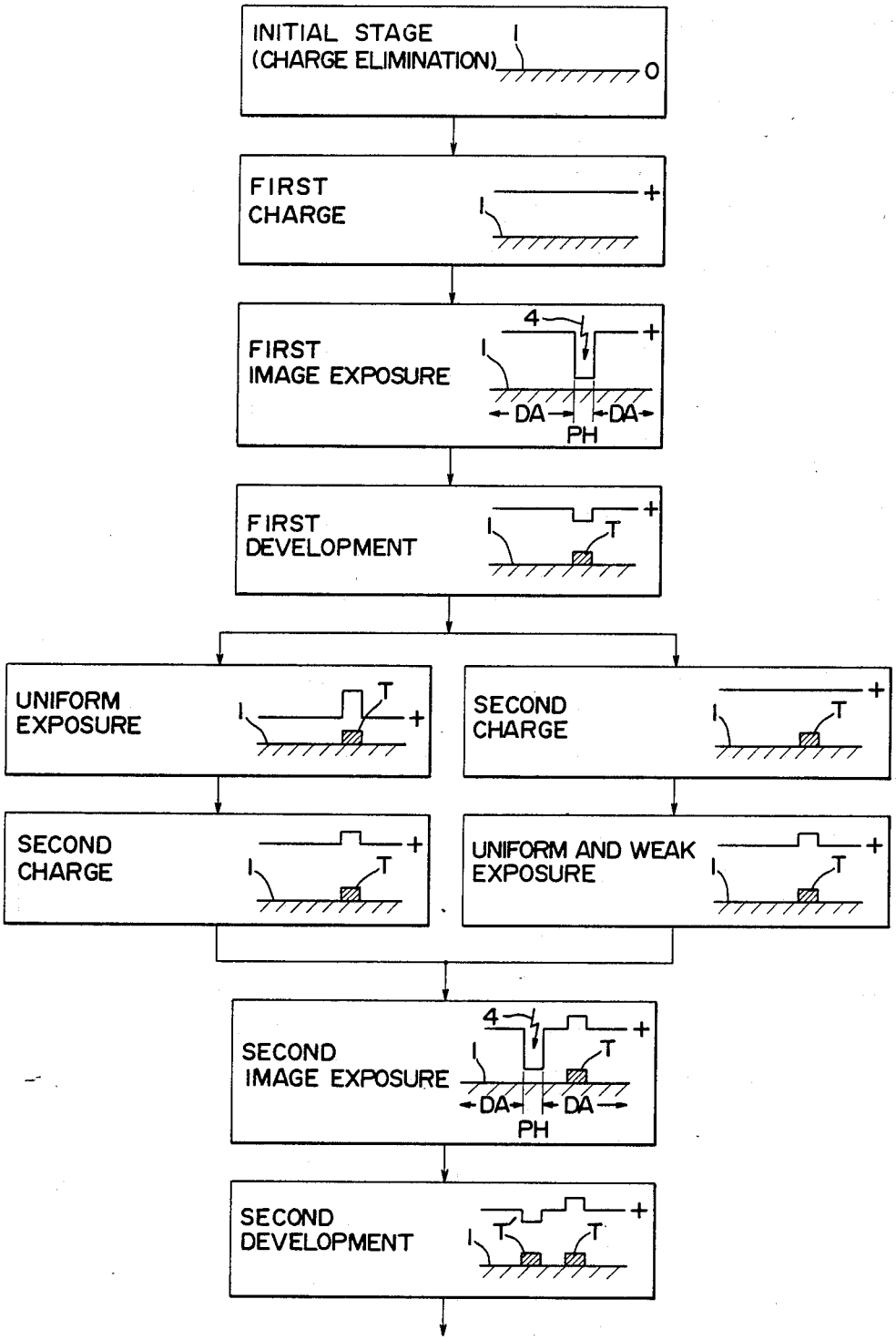

FIGS. 5 to 7 show embodiments of reversal development according to the present invention, in which an electrostatic image is formed by the method of forming an image exposed portion into the electrostatic image at a lower potential than the background and in which the developments are carried out such that toners for charging the electrostatic images at the same polarity as that of the background stick to the electrostatic images.

In the embodiment of FIG. 5 using the recording apparatus of FIG. 1(*a*), the surface of the image retainer 1 in the same initial state as that of FIG. 4 is uniformly charged for a first rotation by the charging device 11. This charged surface is subjected to a first image exposure to have a substantially zero potential in the electrostatic image by projecting the image exposure to the image exposing unit 21 with the laser beam scanner of FIG. 2. The electrostatic image thus obtained is subjected to a first development by that of the developing devices 31 and 32, which uses the developer (which has its toner for charging in the same polarity as that of the charging operation of the image retainer 1, as is different from the embodiment of FIG. 4) containing the color toner corresponding to the image exposure. For forming subsequent latent image formations, a second image exposure is conducted by projecting the image exposure to the image exposing unit 22 in a position displaced from the position of the preceding projection with the laser beam scanner. The resultant electrostatic image having a substantially zero potential is developed by either the remaining developing devices 33 or 34 using the developer containing the corresponding color toner. For a second rotation, third and fourth electrostatic image formations and developments are repeated. Then, the one color image recording cycle is completed like FIG. 4. Incidentally, in this embodiment, the electrostatic image having the substantially zero potential will not take a potential substantially equal to that of the background, as shown, even if it is developed to carry the toner T for charging it in the same polarity as that of the image retainer 1. As a result, during the development for applying the toner T' of different color to the electrostatic image formed later, the toner T' will frequently stick to the previous toner T of the electrostatic image portion despite of no previous exposure, i.e., not write. Since, however, the laser beam scanner which can be formed as a unit is used for generating the image exposure. The laser beam scanner can be arranged around the image retainer 1, the projection position of each image exposure can be displaced very simply, so that no recharging for forming the latent image for the second and following colors is necessary because the charge for the latent image of the first color can be used as it is. The liability for the electrostatic images of different colors to be superposed can be reduced by setting the DC biases at sequentially lower absolute values for the individual developments. Thus, it is possible to form a color image, especially a multi-color image having an excellent clearness.

An embodiment of FIG. 6 is an improvement over that of FIG. 5, in which an additional electrostatic image cannot be positively formed on the preceding electrostatic image and in which the toner of different color may possibly be caused, although very little, to stick to the previously developed electrostatic image portion by a later development. In the embodiment of FIG. 6, more specifically, the process from the initial step to the first development is common to that of the embodiment of FIG. 5. However, the subsequent steps are different from those of the embodiment of FIG. 5. Specifically, a second charging operation is uniformly conducted by the charging device 12. This charged surface is subjected to a second image exposure and a second development. Likewise, third and fourth electrostatic image formations and developments are subsequently repeated. Thus, in the embodiment of FIG. 6, as like as the embodiment shown in FIG. 4, in which after the preceding development the surface of the image retainer 1 is again charged uniformly for the succeeding electrostatic image formations and developments, an electrostatic image can be formed on the portion bearing the preceding electrostatic image. Even in case, moreover, the portion of the succeeding electrostatic image is displaced from that of the preceding one, there can be attained an effect that the toner of different color hardly sticks to the portion of the image to which the preceding toner has sticked.

FIG. 7 presents an embodiment for preventing the succeeding toner of different color from sticking to the portion to which the preceding toner has sticked. This embodiment is the same in the process up to the first development as that of the embodiments of FIGS. 5 and 6. After the first development, however, the surface of the image retainer 1 is uniformly exposed by the use of an exposing lamp 71, as shown in FIG. 1(*b*). Then, a second charging operation is conducted by the charging device 12. Alternatively, the second charging operation is uniformly conducted in advance by the charging device 12, and a weak but uniform exposure is then conducted by the exposing lamp 71 shown by phantom line. Then, a second image exposure and a second development are conducted. Subsequently, third and fourth electrostatic image formations and developments are likewise repeated. Here, if a uniform exposure is conducted after the development, the portion developed to bear the toner does not have its charged eliminated but is maintained at a high potential whereas the remaining portion is dropped to a substantially zero potential. By the second charging operation, the surface of the image retainer 1 can be charged such that the potential at the portion bearing the toner is made slightly higher than that at the remaining portion to be formed with the electrostatic image. After the development, moreover, if the second charging operation is conducted in advance to uniformly charge the surface of the image retainer 1 and then the uniform and weak exposure is conducted, the charged state of the surface of the image retainer 1 is similar to that in case the uniform exposure is conducted in advance.

Therefore, when a succeeding electrostatic image having its position displaced is to be developed, a toner of different color is effectively prevented from sticking to the portion bearing the preceding toner because the latter portion is at a higher potential.

In any of the embodiments thus far described, the developing devices 31 to 34 may preferably use the developer of the mixture of the toner and the insulating carrier, and the developments may also preferably conducted under the non-contact development conditions. This prevents the mixture of the toners of different colors, as has been described hereinbefore. Moreover, application of the bias voltage suitable for the toner control to the developing sleeve 131 of the developing device is facilitated so that a color image having a high developing density and an excellent clearness can be recorded even in the electrostatic image forming and developing methods, in which the image exposing device such as the laser beam scanner can be advantageously used, as in the embodiments of FIGS. 5 and 7.

As can be understood from FIGS. 4 to 7, the charging device and the image exposing device constitute together the electrostatic image (i.e., latent image) forming means.

Next, the embodiments of FIGS. 4 to 7 will be described more specifically as the following examples 1 to 3:

EXAMPLE 1

(Embodiment of FIG. 4)

The recording apparatus shown in FIG. 1(*a*) was used. The image retainer 1 had an OPC (i.e., Organic Photoconductive) surface layer and a circumferential velocity of 90 mm/sec. The surface of this image retainer 1 was charged to −600 V by the charging device 11 using the scorotron corona discharger, and this charged surface was subjected to a first image exposure with blue image information by the image exposing unit 21. As a result, the image retainer 1 was formed with an electrostatic image in which the background potential of the exposed portion was at −50 V whereas the potential of the unexposed portion was −600 V. This electrostatic image was subjected to a first development by the developing device 31 shown in FIG. 3.

The developing device 31 used the developer which was composed of: a carrier containing 50 wt % of magnetite dispersed in a resin and having an average particle diameter of 20 μm, a magneticism of 30 emμ/g and a resistivity of $10^{14}$ Ωcm or higher; and a non-magnetic toner prepared by adding 10 wt parts of benzidine derivative as a yellow pigment and another charge controlling agent to a styrene-acrylic resin and having an average particle diameter of 10 μm. The using condition was that the ratio of the toner to the carrier was 25 wt %. Moreover, the developing device 31 resorted to the non-contact development conditions, in which: the developing sleeve 131 had an external diameter of 30 mm and the number of revolutions of 100 r.p.m.; the magnet 32 had the density of magnetic flux of 1,000 gauses on the developing sleeve of its N and S magnetic poles and the number of revolutions of 1,000 r.p.m.; the developer layer in the developing region had a thickness of 0.7 mm; the gap between the developing sleeve 131 and the image retainer 1 was 0.8 mm; and the developing sleeve 131 was supplied with the superposed voltage of a DC voltage of −100 V and an AC voltage of 3 kHz and 1,000 V (at an effective value).

While the electrostatic image was being developed by the developing device 31, the remaining similar developing devices 32 to 34 shown in FIG. 3 were kept away from their developing states. This could be achieved by isolating the developing sleeve 131 from the power supply 139 into a floating state or by positively applying a DC bias voltage in the same polarity as that of the charged image retainer 1, i.e., in the opposite polarity to that of the charged toner to the developing sleeve 131. Since the developing devices 32 to 34 are used for the developing operations under the non-contact conditions as like as the developing device 31, the developer layer on the developing sleeve 131 need not be troublesomely eliminated. The developing device 33 used the developer having the composition, in which the toner of the developer of the developing device 31 was replaced by the toner containing polytungstorate as the magenta pigment in place of the yellow pigment. The developing device 32 used the developer having the composition, in which the toner is replaced by the toner containing copper phthalocyanine as the cyan pigment. The developing device 34 used the developer having the composition, in which the toner was replaced by the toner containing carbon black as the black pigment. Naturally, these color toners may contain other pigments, dyes, and the orders of the colors to be developed and the developing devices can be suitably selected.

The surface of the image retainer 1 having been subjected to the first development was recharged to −650 V by the action of the charging device 12. The charged surface was subjected to a second image exposure with green image information by the image exposing unit 22 and then to a second development with the magenta toner by the developing device 33 under the non-contact development conditions in which the superposed voltage of a DC voltage of −150 V and an AC voltage of 1,000 V was applied to the developing sleeve 131. Next, for a second rotation, a charging step, an image exposure to red image information by the image exposing unit 21 and a third development with the cyan toner by the developing device 32; and a charging step, an image exposure to black image information by the image exposing unit 22 and a fourth development with the black toner by the developing device 34 were repeated. Incidentally, in the second and later development, the amplitudes, frequencies, time selected conversions of the DC bias and AC components of the voltage to be applied to the developing sleeve 131 were suitably changed in conformity to the changes in the surface potential, developing characteristics and color reproducibility of the image retainer 1. Especially, the sequential increase in the absolute value of the DC bias as well as the charging potential was effective to prevent the color mixture of the toners.

When the fourth development was conducted to form the four-color images on the image retainer 1, they were prepared by the pre-transfer charging device 13 and the pre-transfer exposing lamp 41 and were transferred to the transfer member P by the transfer device 14 until they are fixed by the fixing device 61. The suitable exposure by the pre-transfer exposing lamp 41 is effective for making the transfer member P liable to be separated from the image retainer 1. The image retainer 1 thus having the color images transferred thereto had its charges eliminated by the charge eliminating devices 15 and 42 and further its residual toners removed from its surface by the cleaning blade or sponge roller of the cleaning device 51. Thus, the one cycle process for recording the color image was completely finished when the surface bearing the color image passed over the cleaning device 51.

The color image thus recorded was clear with its individual colors exhibiting sufficient densities. However, the toner mixture was slightly found in the portion where the color toners sticked densely.

EXAMPLE 2

(Embodiment of FIG. 5)

The recording apparatus shown in FIG. 1(*a*) was used. The image retainer 1 had a surface layer of a photosensitive material of Se and a circumferential velocity of 180 mm/sec. The surface of this image retainer 1 was charged to +800 V by the charging device 11 using the scorotron corona discharging device, and the charged surface was subjected to a first image expsoure with a density of 16 dots/mm by the image exposing unit of FIG. 2 using the He-Ne laser. As a result, an electrostatic image having a potential of +50 V in the exposed portion and a background potential of +800 V was formed on the image retainer 1. This electrostatic image was subjected to a first development by the developing device 31 shown in FIG. 3.

Incidentally, the development conditions by the developing device 31 were the same as those of the Example 1 except that the developer had the carrier of an average particle diameter of 30 μm and a ratio of 20 wt % of the toner to the carrier, and that a superposed voltage of a DC voltage of +600 V and an AC voltage of 1.5 kHz and 700 V (in an effective value) was applied to the developing sleeve 131. Moreover, the conditions of the remaining developing devices 32 to 34 were the same as those of the Example 1 except the bias voltage. In this Example 2, however, the bias voltage for holding the developing device, which does not participate in the development, in its non-developing state has an opposite polarity to that of the charge of the toner and the charge of the image retainer 1.

The surface of the image retainer 1 having been subjected to a first development was subjected to a second image exposure by the image exposing unit 22 without the action of the charging device 12 and with not change in the density but displacement of the dot positions. The surface thus exposed was then subjected to a second development with the magenta toner by the developing device 33. For a second rotation, a third development with the cyan toner by the developing device 32 and a fourth development with the black toner by the developing device 34 were repeated. Incidentally, in and after the second developments, the amplitudes, frequencies, time selected conversions of the DC bias and AC components of the voltage to be applied to the developing sleeve 131 were suitably changed in conformity to the changes in the surface potential, developing characteristics and color reproducibility of the image retainer 1. Especially, in this Example, the sequential reduction in the DC biases for each step is effective for preventing the color mixture of the toners.

When the fourth development was conducted to form four-color images on the image retainer 1, they were transferred to and fixed on the transfer member P, like the Example 1, and the one color image recording cycle was then completed by eliminating the charges of and cleaning the image retainer 1.

The color image thus recorded was as clear as that of the Example 1.

EXAMPLE 3

(Embodiment of FIG. 6)

The color image recording was conducted by using the same apparatus as that of the Example 2 under the same conditions as those of the Example 2 except that the voltage to be applied to the developing sleeve 131 of the developing device was the superposed voltage of a DC voltage of +600 V and an AC voltage of 1,000 Hz and 500 V (in an effective value), and that the surface potential of the image retainer 1 was subsequently recharged to +900 V by the charging device 12.

The color image recorded had less color mixture of the toners in the portion, where the individual color toners densely sticked, to provide a clearer image than that of the Example 2.

Incidentally, according to this Example, as has been touched hereinbefore, the portion of the preceding image exposure and the portion of the succeeding image exposure can be superposed. In this case, the order of the colors to be developed exerts considerable influence on the clearness of the color image to make it necessary to determine the color order carefully.

EXAMPLE 4

(Embodiment of FIG. 7)

The recording apparatus used had the exposing lamp 71 (as indicated by the phantom line) between the charging device 12 and the image exposing unit 22, as shown in FIG. 1(*b*). The color image recording was conducted under the same conditions as those of the Example 2 except that the voltage to be applied to the developing sleeve 131 of the developing device was the superposed voltage of a DC voltage of +450 V and an AC voltage of 2 kHz and 500 V (in an effective value), and that before each of second and later image exposures the surface of the image retainer 1 was charged to have a potential +600 V by the charging device 11 or 12 and subjected to a uniform and weak exposure to drop its potential to +500 V by the exposing lamp 71 (as indicated by the phantom line).

The color image thus recorded was remarkably clear because no color mixture of the toners was present even in the portion where the individual color toners sticked closely to each other.

In this Example, too, the portion of the preceding image exposure and the portion of the succeeding image exposure can be superposed like the Example 3.

According to this Example, by using two sets of apparatus for forming the electrostatic images by four repetitions, the recording apparatus can be constructed in a small size and at a low cost, and the recording speed is relatively, and further the synchronized control of the individual image exposures can be done easily and accurately because toner images of plural colors are formed on the image retainer 1 and transferred at a time. Moreover, each development can be conducted either by the method of applying the toner to be charged in the opposite polarity to an electrostatic image which can have its density controlled relatively easily or by the method of applying the toner to be charged in the same polarity to an electrostatic image which can use the image exposing unit as the image exposing device. According to either method, furthermore, the development can be conducted under the non-contact development conditions to record a color image having a sufficient developing density and an excellent clearness.

In addition to the Examples described above, the present invention can be modified in various manners.

In case any color image need not be formed, i.e., a monochromatic image is to be formed, for example, the latent image can be formed by any combination of the charging device 11 or 12 and the image exposing unit 21 or 22. In case the photosensitive layer of the image retainer 1 has a large dark decay, the latent image may preferably be formed by the combination of the charging device 12 and the image exposing unit 22 and developed by the developing device 34. This is because the short time intervals (or distances) between the individual charging, image exposing and developing steps can be utilized. The combinations may be selected on the basis of the same concept in case a mono-color image is to be formed of toner of another color such as the yellow, magenta or cyan color.

In the dichromatic or trichromatic case, any combination can naturally be selected in accordance with the necessity or performance.

Further, it is possible to superpose the image informations of 2n (wherein n is the rotation number of the drum) on the image retainer and to transfer them on the transfer paper, if not only the information from the document of one sheet is written by the image exposing unit on the image retainer but also the informations of the document of plural sheets or the different image informations from the external input signals are written on the image retainer, and developed by some developing devices.

By suitably selecting the combination of the image exposures and the developing devices, a variety of color images can also be formed.

By feeding toners of the same color but different lightnesses (e.g., black and grey toners) to the individual developing devices, it is possible to form a white and black (or mono-color) image having a gradation (for reproducing a delicate density difference).

In addition, the image composition can be conducted on the image retainer 1 by performing the image exposures of different image informations coming from the image exposing units 21 and 22.

As has been touched hereinbefore, furthermore, the present invention should be limited neither to the recording apparatus having the drum-shaped image retainer nor to the transfer of a color image to the transfer member. In short, the present invention can also be applied to a modification, in which the image forming member is one to be applied to a base such as electrofax paper so that a color image formed on the member is not transferred but fixed. In this modification, the pre-transfer charging device, the pre-transfer exposing lamp, the transfer device, the cleaning device and so on can be dispensed with. Of these, the pre-transfer charging device, the pre-transfer exposing lamp and the charge eliminating device can also be omitted in the case of transfer. And, this transfer itself may be a pressure one or through an intermediate transfer member. It is also natural that the fixing should not be limited to that using heat rollers.

Other embodiments of the apparatus of the present invention different from the embodiment shown in FIG. 1(*a*) will be explained with reference to FIGS. 9 and 10.

Figure 9:
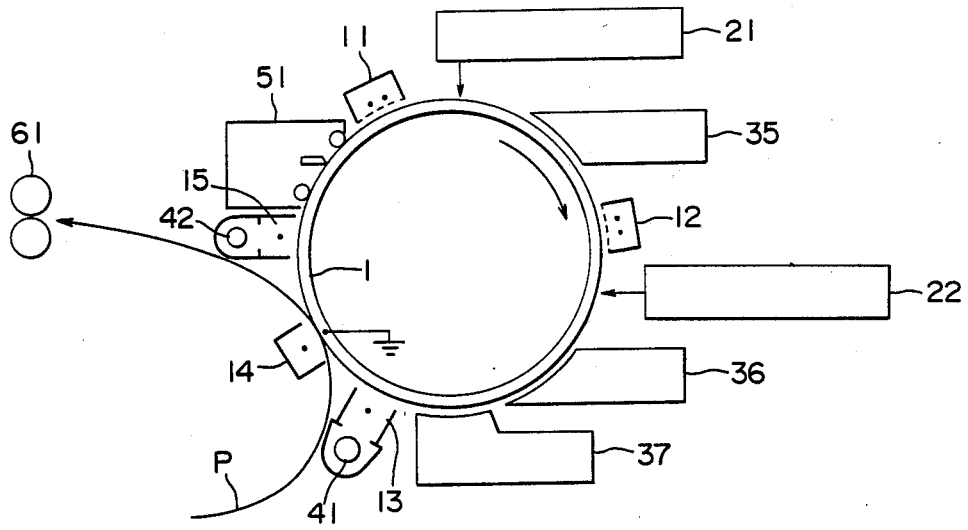
FIGS. 9 and 10 are explanatory views showing another examples of recording apparatus.

In the embodiment shown in FIG. 9, two image exposing units and three developing devices. Different color toners of yellow, magenta and cyan may be used as the color toners of developers for the three developing devices. However, in this embodiment, red toner is used as the color toner of developer for the developing device 35, blue toner is used as the color toner of developer for the developing device 36, and black toner is used as the color toner of developer for the developing device 37. The process of image formation using this apparatus will be explained hereunder.

First rotation of image retainer 1

1. The image retainer 1 of the photosensitive member (O.P.C.) is charged uniformly to −600 V by the first charging device 11 (scorotron).

2. A red color image information for forming a latent image corresponding to red color is written by the first image exposing unit (infrared ray laser) 21. Thus, the potential on the image exposed portion is reduced to −20 V.

3. A reverse development is carried out by the developing device 35 having red color toner.

4. The photosensitive member on which the red color toner image exists is charged uniformly again to −600 V by the second charging device (scorotoron) 12.

5. A blue color image information for forming a latent image corresponding to blue color is written by the second image exposing unit (infrared ray laser) 22. Thus, the potential on the image exposed portion is reduced to −20 V.

6. A reverse development is carried our by the developing device 36 having blue toner.

Second rotation of image retainer 1

7. The photosensitive member on which the red color toner image and the blue color toner image exist is charged uniformly further to −600 V by the second charging device 12. The first charging device 11 may be used instead of the second charging device 12.

8. An information corresponding to black color is written by the second image exposing unit 22. The first image exposing unit 21 may be used instead of the second image exposing unit 22.

9. A reverse development is carried out by the developing device 37 having black toner.

The remaining processes of the image information are the same with that explained in FIG. 1.

It may be possible to form the toner images by using the image exposing units 21 and 22 suitably combined with the developing devices 35, 36 and 37. It is preferable to use the non-contact development.

Figure 10:
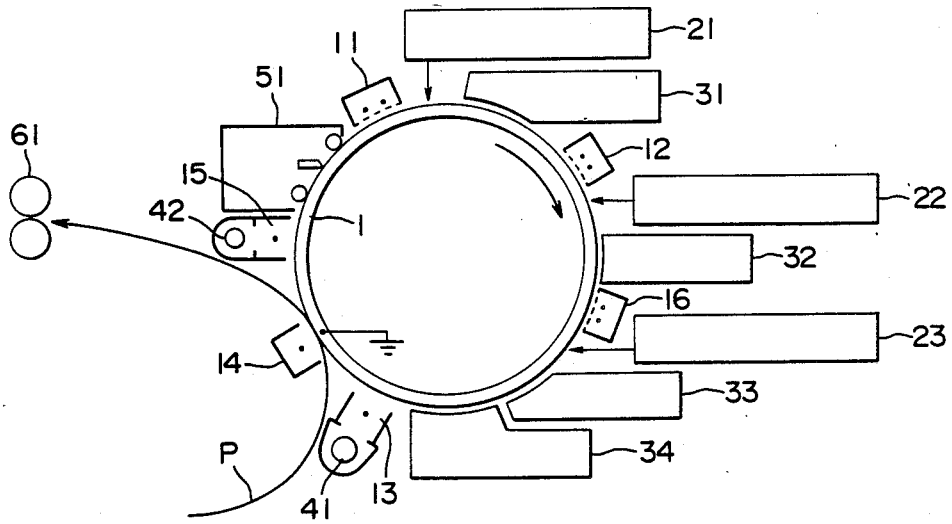

In the embodiment shown in FIG. 10, three image exposing units and four developing devices are used. The process of image formation using this apparatus will be explained hereunder.

First rotation of image retainer 1

1. The image retainer 1 of the photosensitive member (O.P.C.) is charged uniformly to −600 V by the first charging device 11 (scorotron).

2. A yellow color image information for forming a latent image corresponding to yellow color is written by the first image exposing unit (infrared ray laser) 21. Thus, the potential on the image exposed portion is reduced to −20 V.

3. A reverse development is carried out by the developing device 31 having yellow color toner.

4. The photosensitive member on which the red color toner image exists is charged uniformly again to −600 V by the second charging device (scorotron) 12.

5. A magenta color image information for forming a latent image corresponding to magenta color is written by the second image exposing unit (infrared ray laser) 22. Thus, the potential on the image exposed portion is reduced to −20 V.

6. A reverse development is carried out by the developing device 32 having magenta toner.

7. The photosensitive member on which the yellow color toner image and the magenta color toner image exist is charged uniformly further to −600 V by the third charging device 16. The first charging device 11 may be used instead of the second charging device 12.

8. An information corresponding to cyan color is written by the third image exposing unit (infrared ray laser) 23. Thus, the potential on the image exposed portion is reduced to −20 V.

9. A reverse development is carried out by the developing device 33 having cyan toner.

Second rotation of image retainer 1

10. The photosensitive member on which the yellow color toner image, cyan color toner image and the magenta color toner image exist is charged uniformly further to −600 V by the third charging device 16. The charging device 11 or 12 may be used instead of the third charging device 16.

11. An information corresponding to black color is written by the third image exposing unit 23. The image exposing unit 21 or 22 may be used instead of the third image exposing unit 23.

12. A reverse development is carried out by the developing device 34 having black toner.

The remaining processes of the image formation are the same with that explained in FIG. 1.

As has been described hereinbefore, the present invention can enjoy the following effects:

(1) Since there are used a plurality of latent image forming means at least one of which is used repeatedly, latent images of the number corresponding to that of this repetition can be formed only by said at least one latent image forming means. As a result, the number of the latent image forming means can be reduced to make a small-sized image forming apparatus.

(2) At least one of the plural latent image forming means is used repeatedly, and developing means are used for developing the respective latent images formed by those latent image forming means. As a result, the number of movements of the image retainer (or the number of rotations in case it has a drum shape) for retaining the aforementioned latent images and the visible images formed by developing the latent images can be made as many as the number of the latent image forming means. As a result, the image can be formed at a high speed such that the number of movements of the image retainer is smaller than that of the developing means.

What is claimed is:

1. An image forming method comprising the steps of;

forming a first latent image corresponding to a first color on a region of an image retainer with a first charging means and a first exposing means and developing the first latent image with a developing means containing toner of said first color during a first rotation of said image retainer;

forming a second latent image corresponding to a second color on said region with a second charging means on a second exposing means and developing the second latent image with a developing means containing toner of said second color during said first rotation of said image retainer and;

forming a third latent image corresponding to a third color on said region of the image retainer with said second charging means and said second exposing means and developing the third latent image with a developing means containing toner of said third color during a second rotation of said image retainer.

2. An image forming method according to claim 1 wherein a plurality of toner images are formed on an image retainer by repeating plural times latent image formation and said development, and then transferred at a time on a transfer paper.

3. The method of claim 1 wherein each of said first and second exposing means is a laser beam scanner.

4. The method of claim 1 wherein said first and second exposing means scan different positions of said image retainer with light.

5. An image forming method according to claim 2, wherein said image retainer is a photosensitive member.

6. The method of claim 5 wherein said plural toner images are color toner images different from one another in color.

7. An image forming method according to claim 6, wherein said latent image forming means has charging means and exposing means.

8. The method of claim 7 wherein said exposing means is a laser beam scanner.

9. An image forming method according to claim 8, wherein said developing is a reverse developing.

10. An image forming method according to claim 9, wherein said developing is a non-contact developing.

11. The method of claim 10 wherein developing is carried out under an oscillating electric field using a two-component developer, said developer having toner particles and carrier particles, said carrier particles having a resistivity of more than $10^8$ Ω cm.

12. An image forming method comprising the steps of forming a first latent image corresponding to a first color on a region of an image retainer with a first charging means and a first exposing means and developing said first latent image with a developing means containing toner of said first color during a first rotation of said image retainer;

forming a second latent image corresponding to a second color on said region with a second charging means and a second exposing means and developing said second latent image with a developing means containing toner of said second color during said first rotation of said image retainer;

forming a third latent image corresponding to a third color on said region of the image retainer with said first charging means and said first exposing means and developing the third latent image with a developing means containing toner of said third color during a second rotation of said image retainer and;

forming a fourth latent image corresponding to a fourth color on said region with said second charging means and said second exposing means and developing the fourth latent image with a developing means containing toner of said fourth color during said second rotation of said image retainer.

13. The method of claim 12 wherein each of said first and second exposing means is a laser beam scanner.

14. The method of claim 12 wherein said first and second exposing means scan different positions of said image retainer with light.

15. The method of claim 12 wherein, after formation, the four toner images formed on said image retainer are transferred to a transfer member.

16. An image forming apparatus comprising;

first latent image forming means, a first group of developing means, second latent image forming means, and a second group of developing means;

wherein said first latent image forming means, said first group of developing means, second latent image forming means, and second group of developing means are sequentially arranged opposite the face of an image retainer, wherein said first group of developing means and/or said second group of developing means comprises a plurality of developing means, wherein a first latent image corresponding to a first color is formed by said first latent image forming means, and developed by said first group of developing means, and a second latent image corresponding to a second color is formed on said image retainer by said second latent image forming means, and developed by said second group of developing means during a first rotation of said image retainer, and a third latent image corresponding to a third color is formed on said image retainer by said first latent image forming means, and developed by said first group of developing means during a second rotation of said image retainer.

17. The apparatus of claim 16 wherein a fourth latent image corresponding to a fourth color is formed on said image retainer by said second latent image forming means, and developed by said second group of developing means during said second rotation of said image retainer.

18. An image forming apparatus according to claim 16 wherein said first group of developing means or said second group of developing means has two developing devices.

19. An image forming apparatus according to claim 16 wherein said first group of developing means and said second group of developing means each have two developing means.

20. An image forming apparatus according to claim 19, wherein said first group of developing means and said second group of developing means are used for the reverse development.

21. An image forming apparatus according to claim 20, wherein said first group of developing means and said second group of developing means are used for the non-contact development.

22. An image forming apparatus according to claim 16, further comprising third latent image forming means and third developing means.

* * * * *